US008214962B2

(12) United States Patent
Rohrig

(10) Patent No.: US 8,214,962 B2
(45) Date of Patent: Jul. 10, 2012

(54) DEVICE FOR MASSAGING THE JAW OR CLEANING THE TEETH, AND METHOD FOR THE PRODUCTION OF THE DEVICE

(75) Inventor: Peter Rohrig, Vienna (AT)

(73) Assignee: Mam Babyartikel Gesellschaft m.b.H., Vienna (AT)

( * ) Notice: Subject to any disclaimer, the term of this patent is extended or adjusted under 35 U.S.C. 154(b) by 702 days.

(21) Appl. No.: 12/373,960

(22) PCT Filed: Jul. 5, 2007

(86) PCT No.: PCT/AT2007/000340

§ 371 (c)(1),
(2), (4) Date: Jan. 15, 2009

(87) PCT Pub. No.: WO2008/009034

PCT Pub. Date: Jan. 24, 2008

(65) Prior Publication Data

US 2009/0249571 A1 Oct. 8, 2009

(30) Foreign Application Priority Data

Jul. 17, 2006 (AT) ..... GM549/2006
Aug. 1, 2006 (AT) ..... GM585/2006

(51) Int. Cl.
*A61J 17/00* (2006.01)
*A61H 13/00* (2006.01)
*A46B 9/04* (2006.01)

(52) U.S. Cl. ..... 15/110; 15/143.1; 15/167.1; 15/167.2; 15/188; 601/139; 601/141; 606/234; 606/235

(58) Field of Classification Search ..... 15/110, 15/143.1, 167.1, 167.2, 188; 601/139, 141; 606/234, 235; 300/21
See application file for complete search history.

(56) References Cited

U.S. PATENT DOCUMENTS 3,753,266 A * 8/1973 Ceniceros ..... 15/110
5,048,143 A * 9/1991 Carroll ..... 15/110
5,160,344 A 11/1992 Werton
5,175,901 A 1/1993 Rabinowitz
5,615,443 A 4/1997 Lai
6,134,737 A * 10/2000 Remme ..... 15/110
D569,002 S 5/2008 Roehrig
(Continued)

FOREIGN PATENT DOCUMENTS

CA 1 329 868 C 5/1994
DE 70949 11/1892
EP 1 611 818 A1 1/2006
(Continued)

OTHER PUBLICATIONS

International Search Report: PCT/AT2007/000340.

*Primary Examiner* — Mark Spisich
(74) *Attorney, Agent, or Firm* — Ladas & Parry LLP

(57) ABSTRACT

A device for massaging the jaw or cleaning the teeth of a baby. The device has a handle and a plate-shaped bite part which is curbed in such a way that it essentially corresponds to the curbed shape of the jaw. The bite part has massage or cleaning projections on at least one broad side and is of a material which is softer than that of the handle. The handle and the bite part are interconnected in a nondetachable manner.

20 Claims, 5 Drawing Sheets

U.S. PATENT DOCUMENTS

| | | | |
|---|---|---|---|
| D569,003 | S | 5/2008 | Roehrig |
| 2003/0181948 | A1 | 9/2003 | Dunn et al. |
| 2004/0074035 | A1 | 4/2004 | Huang |
| 2005/0004603 | A1 | 1/2005 | Desousa et al. |

FOREIGN PATENT DOCUMENTS

| | | | |
|---|---|---|---|
| GB | 510 754 | | 8/1939 |
| GB | 2 288 126 | A | 10/1995 |
| WO | 03/065969 | A1 | 8/2003 |

* cited by examiner

Fig. 2
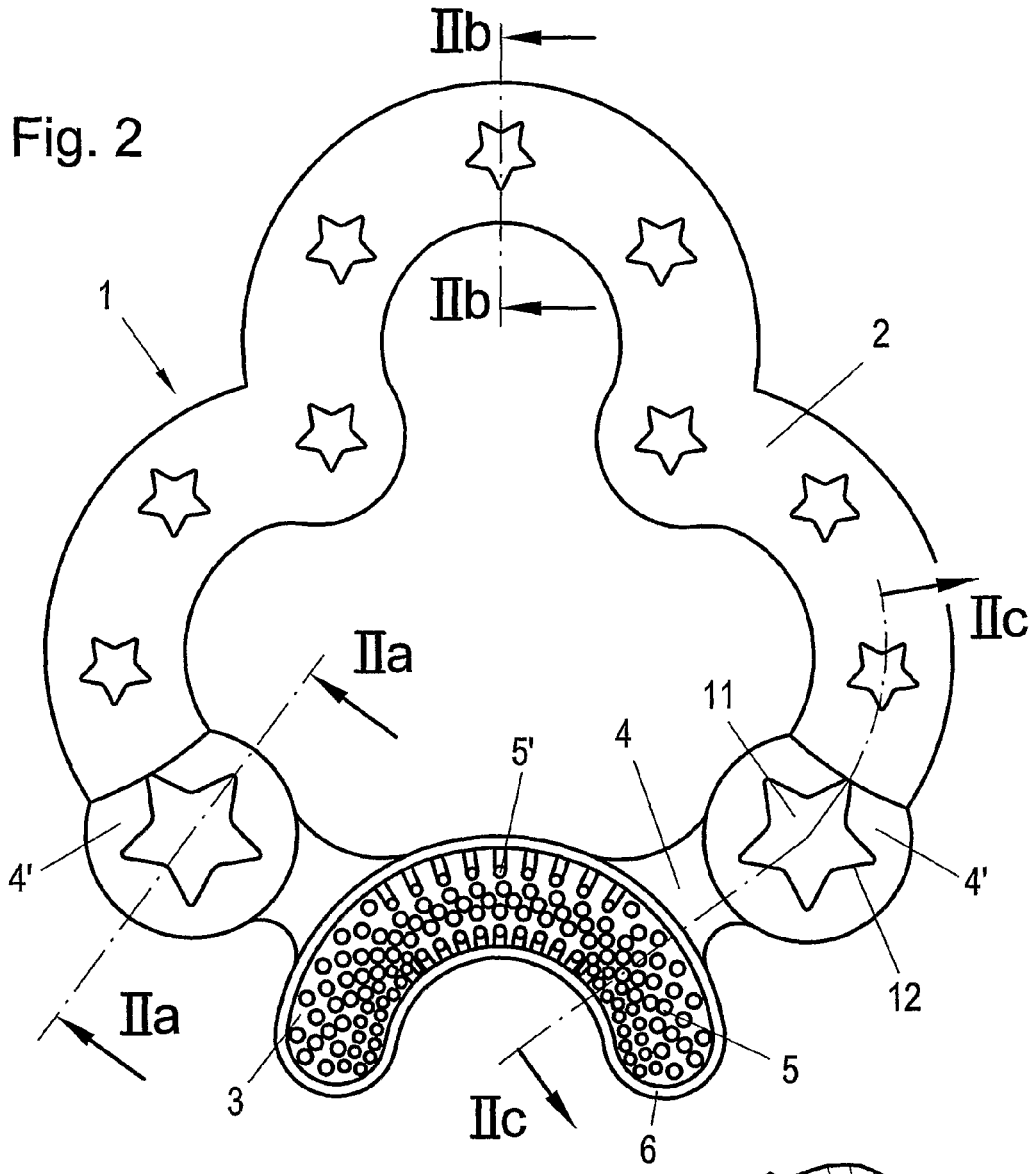
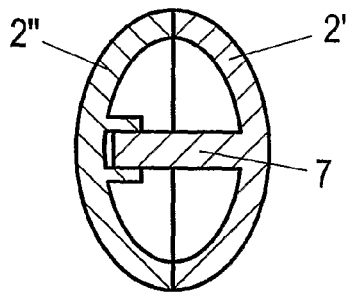
Fig. 2b
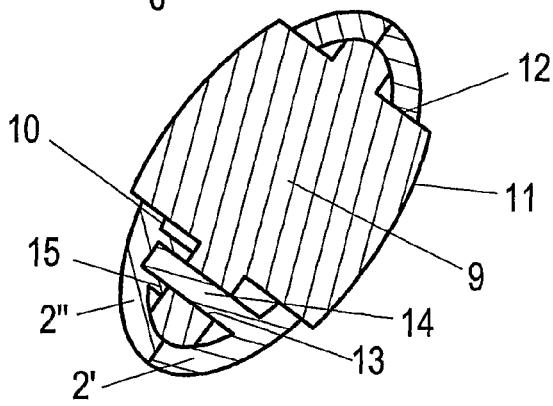
Fig. 2a

Fig. 3
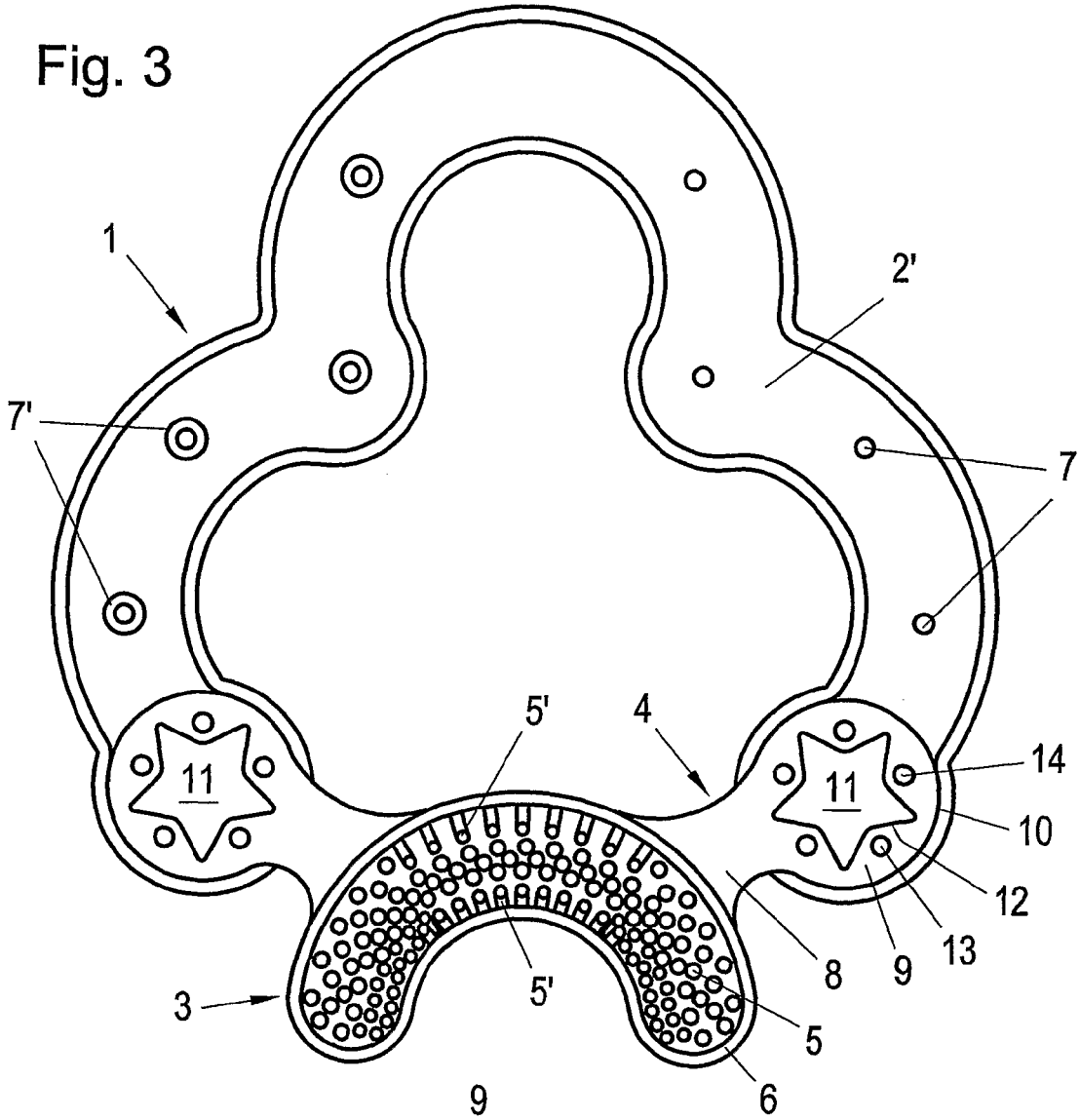
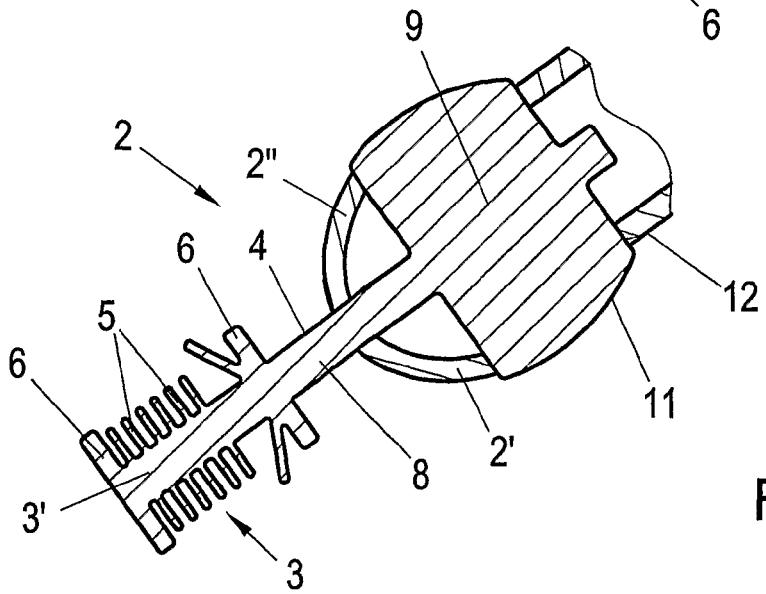
Fig. 2c

DEVICE FOR MASSAGING THE JAW OR CLEANING THE TEETH, AND METHOD FOR THE PRODUCTION OF THE DEVICE

BACKGROUND OF THE INVENTION

The invention relates to a device for massaging the gums and cleaning the teeth of an infant, said device comprising a handle and a plate-shaped bite-on part curved in such a way that it essentially corresponds to the curvature of the jaw. Said bite-on part comprises massage and cleaning projections on at least either the upper or the lower surface and consists of a material that is softer than that of the handle. The invention also relates to a method for producing such device.

Such device is already known from U.S. Pat. No. 5,615,443 A. This device is provided with a U-shaped brush head having cavities on both the upper and the lower surface containing a number of bristles. The brush head may be attached to a somewhat A-shaped handle. For attachment, the two freely protruding legs of the "A" are inserted via end flanges into slits on the outer edge of the U-shaped brush head. Such device may be disassembled easily for transport, but an infant playing with it must not be left unattended because the handle, being detachably connected to the brush head, may unintentionally become loose or even detached rather easily, so there is a risk that an infant may swallow the brush head. This problem is even aggravated by the fact that the handle is relatively small, compared to the brush head, and the connection sites (slits) are located in close proximity to each other. In addition, the toothbrush is rather unwieldy due to the small and relatively impractical shape of the handle, particularly with respect to moving the toothbrush back and forth during use. Another disadvantage of this toothbrush is that it is not possible to effectively massage the gums to soothe a teething infant, because the handle and the brush head are only loosely connected.

In addition, a number of devices of the teether type are known, e.g. from GB 2288 126 A, U.S. Pat. No. 5,160,344 A, US 2003/0181948 A1, or US 2005/0004603 A1. They are all supposed to soothe an infant's gums and/or mitigate irritations during an infant's teething. However, these known teethers have the disadvantage that they are entirely made of either relatively hard or relatively soft material. Therefore, they either do not allow cleaning of the teeth because they are too hard, or they do not allow effective gum massage because the handle is too elastic. In addition, these teethers are generally shaped as rings, so that they only reach the front-most part of an infant's gums. The hind part of the jaw, i.e. the molar area, is not affected by the "treatment". Therefore, it is impossible to soothe or mitigate gum irritations in this area.

For example, WO 2003/065969 A1 discloses a device to support teething, which may also be used as a pacifier. The device is comprised of a U-shaped mouth-engageable portion, a shield and a handle, said handle and said mouth-engageable portion being formed as a unitary piece and thus consisting of the same material.

DE 70 949 C discloses a device to facilitate teething having a U-shaped mouth-engageable portion on which a calcium containing solution is applied or which is impregnated with said liquid. This is supposed to prevent or at least mitigate illnesses. The U-shaped mouth-engageable portion is connected to a safety shield and a handle.

GB 510 754 A discloses a teething ring having a portion to be bitten on and a portion for holding the ring. The bitten-on portion is studded with projections. This ring also consists of one single material.

CA 1 329 868 C discloses a combination of a toothbrush and a teething ring, with bristles provided on the ring. This document does not disclose any bite-on part made of softer material.

EP 1 611 818 A1 discloses a tooth cleaning device for children, wherein a brush and a rattle being attached to a ring. Grip portions are located between the opposing portions of brush and rattle, said grip portions being equipped with protrusions. Again, no relatively soft bite-on portion is provided.

It is the object of the invention to provide a device as described above, which may be used by infants even if they are unattended, and which allows effective massage of the gums and cleaning of the teeth of an infant. In addition, the device should be easy and cheap to produce.

According to the invention, this problem is solved by connecting the handle and the bite-on part in a non-detachable manner. This type of connection allows stable, strain-resistant and, above all, permanent connection of the hard handle and the soft bite-on part, so that the handle can not get detached from the bite-on part unintentionally even under frequent use of the device, and therefore the device may be used by infants even if they are unattended. In addition, the relatively hard handle allows efficient transmission of the user's power to the relatively soft bite-on part equipped with projections for massage and cleaning. This allows both cleaning the young teeth and massaging the gums of a teething infant.

Considering an easy construction for producing a non-detachable connection of handle and bite-on part, it is advantageous to provide the handle with two freely protruding ends for connection to the bite-on part.

For effective cleaning of the teeth and massaging of the gums of an infant, the bite-on part advantageously comprises a circumferential wall extending upwards and downwards from the plate-shaped basic body, the inside of said wall being at least partially equipped with massage and cleaning projections, particularly bristle-like projections. The particular shape and the particularly bristle-like projections have the advantage of allowing extensive cleaning and massaging of the gums and teeth on all sides. This effect is also provided by the infant's more or less intensive biting movements on the bite-on part, thus naturally shifting the bite-on part back and forth. The projections may vary in length and thickness, with the basic body e.g. having shorter projections than the wall extending upwards and downwards. Instead of bristles or knobs, lamella-like massage and cleaning projections may also be provided, of course.

The wall may have the same height and thickness all around the basic body. Alternatively, the wall may have sections of different heights.

It is advantageous for the bite-on part to be formed such that it essentially corresponds to the entire curvature of an infant's jaws. Thus, the entire jaw and gums of an infant may be reached, and even the rear part may be cleaned and massaged at the same time as the front part. This is of particular advantage because, naturally, not all teeth form at the same time. During the very period when the incisors have already erupted from the gums, the canines are at the point of erupting, and the molars have not yet formed at all, the already existing teeth may be cleaned, while simultaneously the irritable lateral and rear parts of the gums may be sensitively massaged by the specially shaped bite-on part. This "treatment" may further be optimized by varying the lengths and thicknesses of the projections on the basic body and on the insides of the circumferential wall around the basic body. In particular, essentially the entire jaws and gums may be massaged or cleaned if the thickness of the wall of the plate-shaped basic body of the bite-on part increases from the center of its curvature towards its ends. Alternatively, it is also possible to provide a wall of the plate-shaped basic body of constant thickness, with the height of the massage and cleaning projections increasing from the center of the curvature of the bite-on part towards its ends. Advantageously, this will make production easier than preparing a basic body with increasing wall thickness. These advantageous embodiments of the plate-shaped basic body may also be provided for detachable connections between handle and bite-on part.

For a simple construction of a non-detachable connection that is easy to produce, it is advantageous to form connecting elements on the bite-on part for connection to the handle, said connecting elements being attached to the handle ends in a non-detachable manner.

It is also advantageous to form the connecting elements on the outer edge of the respective end sections of the bite-on part, extending essentially radially from the center of the curvature of the U-shaped bite-on part. This arrangement of connecting elements on the bite-on part is advantageous because the device as a whole is thus formed stably, and the entire bite-on part may be inserted into the oral cavity without the handle hindering it.

A reliable, non-detachable connection between the bite-on part and the handle is provided by the bite-on part being positively connected to the handle. It may be preferable for each connecting element of the bite-on part to be received positively in an orifice in the handle, particularly in the freely protruding handle ends. A positive connection may concretely be realized in a variety of ways. A positive connection of simple construction is obtained by providing at least one orifice in the handle receiving at least one elevation of the connecting element. The concrete embodiments of such orifices and elevations may be varied as desired.

In addition or alternatively, through borings may be provided in the connecting elements for positive connection of the handle and the bite-on part, with pins on the handle being passed through. Said pins may e.g. be provided on each inside of the handle half ends when the handle is divided into two halves along a central plane that is horizontal when the handle is viewed from the top. For easy alignment of the two handle halves with respect to each other, it is advantageous to provide insert sleeves and corresponding insert pins on the insides of the handle halves for connecting the two halves. The handle halves may be welded, particularly by means of ultrasonic welding, or adhered or snapped together for easy connection of the handle halves in a non-detachable manner.

As an alternative to a positive connection between handle and bite-on part, the handle and the bite-on part may be integrally formed by means of a two component injection molding process to connect the relatively hard handle and the relatively soft bite-on part in a non-detachable manner. This embodiment also ensures easy production and firm connection of the individual components of the device.

According to another characteristic feature, it is advantageous for the handle to essentially have the form of a yoke. E.g. a simple, common U-shape or bow-shape may be chosen, preferably having two or three indentations on the outside and outward bulges on the inside. The latter is particularly well suited for infants, because infants often put something into their mouths while holding it in both hands. In addition, such form looks attractive.

With regard to the use of the device, it is advantageous for the bite-on part to be arranged concavely with respect to the handle. As the bite-on part is thus arranged on the handle such that the infant can easily put it in its mouth, it is particularly easy and comfortable for the infant to bite on it.

As to the material, it is advantageous for the handle to be made of polypropylene, polycarbonate or similar materials. E.g. softened polypropylene may be used as marketed under the trade name Adflex. For efficient massage and cleaning of gums and teeth, the handle preferably has a Shore hardness D of about 20 to about 50, preferably about 30 to about 40.

On the other hand, it is advantageous for the bite-on part to be made of silicone, thermoplastic elastomers or similar materials. Advantageously, the bite-on part has a Shore hardness A of about 30 to about 70, preferably about 45 to about 60.

When the handle is to be integrally connected to the bite-on part, the problem mentioned above with respect to the method of production of the device is solved by preparing the device as an integral piece by means of a two or three component injection molding process. If a three component injection molding process is used, e.g. some individual massage projections may be made harder than the others. Also, the handle may have sections made of softer material than the rest of the handle, resulting in different sensations when touching or biting on the different sections.

Alternatively, if the handle and the bite-on part are to be positively connected and the handle is to be provided in the form of two handle halves to be put together, the device may be produced easily by positively connecting the connecting elements of the bite-on part to the corresponding handle half ends prior to connecting the two handle halves, and then hot welding the handle halves using ultrasonic welding to connect them in a non-detachable manner.

BRIEF DESCRIPTION OF THE DRAWING FIGURES

Hereinafter, the invention will be explained in greater detail using the preferred embodiments depicted in the drawings, wherein FIG. 1 is a perspective view of a device according to the present invention;

FIG. 2 is a top view of the device according to FIG. 1;

FIG. 2*a* is a sectional view along the line IIa-IIa in FIG. 2;

FIG. 2*b* is a sectional view along the line IIb-IIb in FIG. 2;

FIG. 2*c* is a sectional view along the line IIc-IIc in FIG. 2;

FIG. 3 is a top view of one handle half of the device according to FIG. 1 with attached bite-on part;

Figure 4:
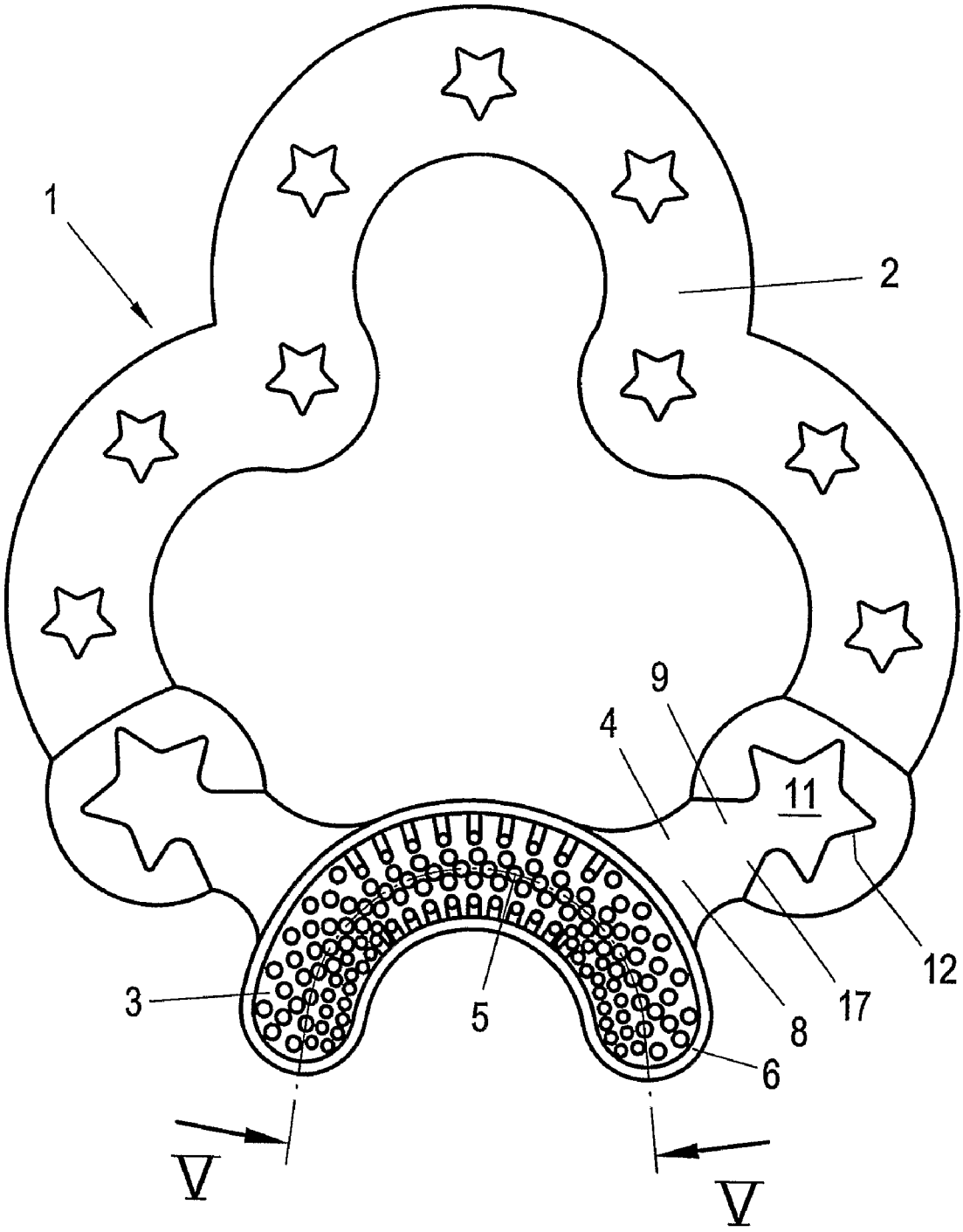
FIG. 4 is a top view of a device formed by means of two component injection molding.
Figure 5:
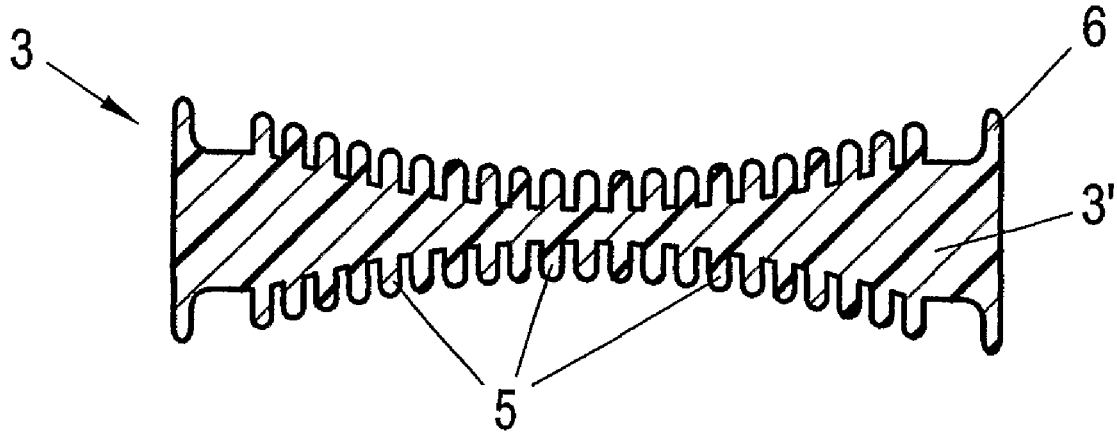
FIG. 5 is a section along the line V-V in FIG. 4.
Figure 5A:
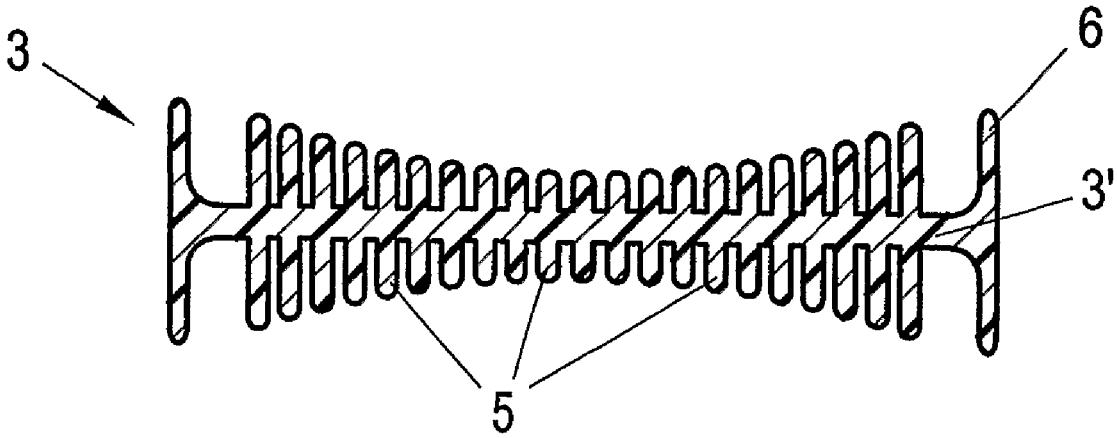

FIG. 5*a* is a section along the line V-V in FIG. 4.

DETAILED DESCRIPTION OF THE PREFERRED EMBODIMENTS

Figure 1:
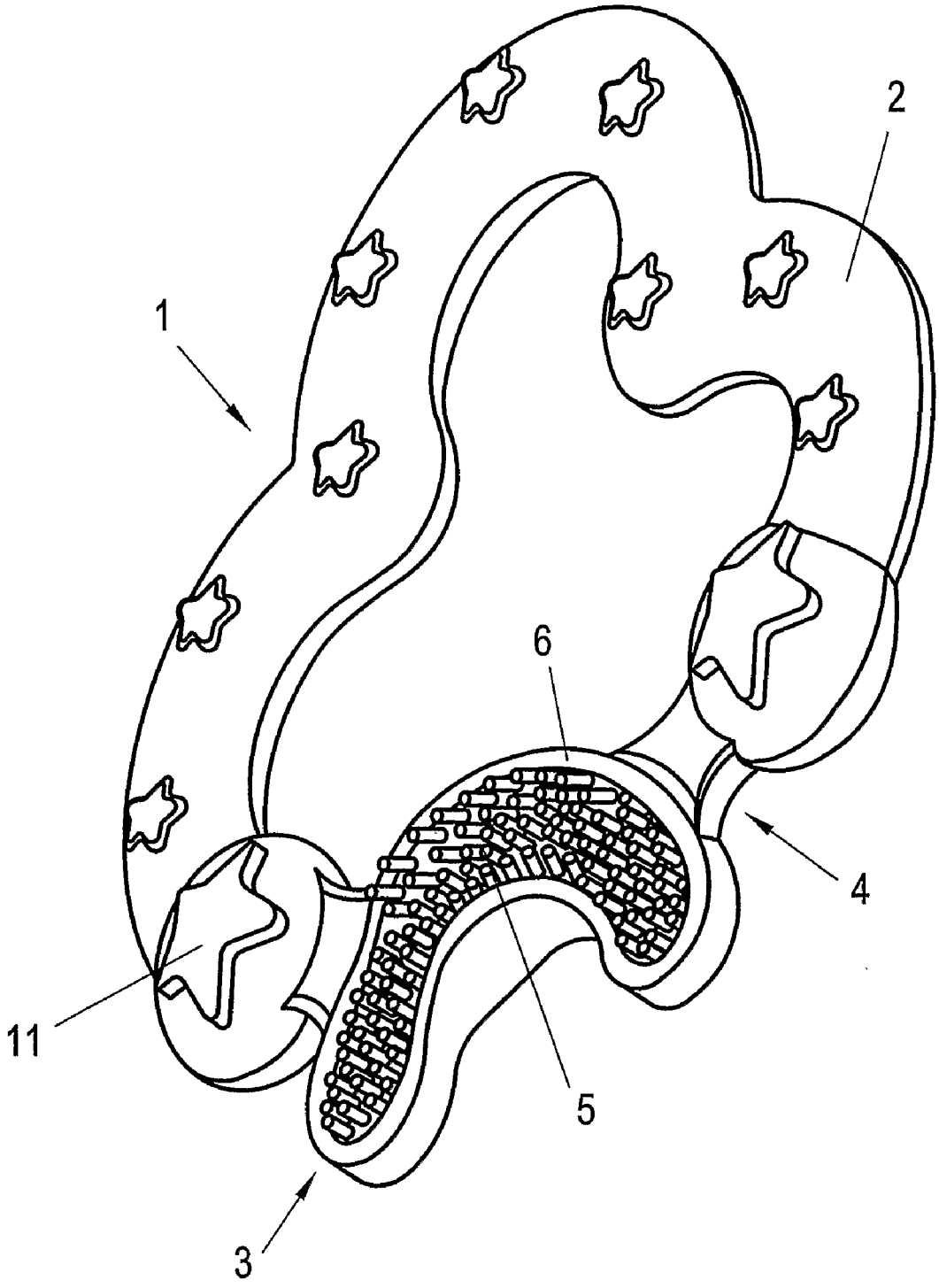

FIGS. 1 and 2 show the device 1 according to the present invention for massaging and cleaning the gums and teeth of an infant, having a handle 2 and a bite-on part 3 positively connected thereto in a non-detachable manner. The handle 2 is U-shaped, having three outward bulges on the inside and two indentations on the outside. The handle 2 has freely protruding ends 4' for connection to the bite-on part 3. The upper side of handle 2 is provided with a regular star pattern to make device 1 look attractive. Handle 2 has rounded edges or is formed so as to have a curved cross section, thus avoiding any sharp edges in device 1.

The bite-on part 3 is curved according to the curvature of an infant's jaws. Starting from the center of the curvature, it comprises an angle of about 180° and can thus reach all parts of an infant's gums. For non-detachable connection of the bite-on part 3 and the handle 2, two connecting elements 4 are formed on the outer edges of each end section of bite-on part 3, which elements extent radially outward from the center of the curvature of bite-on part 3 and are received in the protruding ends 4' of handle 2.

In particular, FIG. 1 also shows that bite-on part 3 has a circumferential wall 6, which is increasing in height from the legs of the essentially U-shaped basic body 3' towards the center of the curvature.

FIGS. 2 and 2*c* show that the bite-on part 3 has a plate-shaped basic body 3' and is arranged concavely with respect to the handle 2, so that device 1 fits perfectly into an infant's mouth. Bite-on part 3 further has bristle-like projections 5 on its upper and lower surfaces, which projections are suitable for massaging and cleaning an infant's gums and teeth. Said projections 5 are made of the relatively soft material of bite-on part 3, such as silicone, having a Shore hardness A of about 30 to about 70, preferably about 45 to about 60.

On the inside of circumferential wall 6, projections 5' are formed corresponding to the projections 5 on the upper and lower surfaces of bite-on part 3. They are longer than the projections 5 on the upper and lower surfaces of bite-on part 3 for easy reach of the external upper and lower gums of an infant. The height of circumferential wall 6 increases from the outer ends of the legs of the essentially U-shaped bite-on part 3 towards the center of the curvature in the middle, as can be seen particularly in FIG. 1.

FIG. 3 is a top view of one handle half 2' of device 1 according to FIG. 1. Handle 2 is divided into two symmetrically formed halves 2', 2" along a central plane that is horizontal when handle 2 is viewed from above. The cross sections of said handle halves 2', 2" are formed as half tubes. Insert pins 7 and insert sleeves 7' are provided at regular distances on the inside of handle half 2', which insert pins 7 are inserted into corresponding sleeves 7' on the inside of the other (upper) handle half 2" and vice-versa to assemble device 1.

The connecting elements 4 extending radially outwards from the end sections of bite-on part 3 each comprise a bridge 8 formed on bite-on part 3 ending in an extended connecting plate 9. For positive connection to handle 2, said connecting plates 9 are positively received in correspondingly formed orifices 10 in the freely protruding ends of handle 2. Said connecting plates 9 have elevations 11 on both their lower and upper sides that are formed as stars in the present example. Said elevations 11 are received in correspondingly formed orifices 12 in the protruding ends 4' of handle halves 2', 2" (cf. FIGS. 2, 2*a*, and 2*c*).

To make the positive connection between handle 2 and bite-on part 3 even more stable, said connecting plates 9 have through borings 13 arranged circumferentially around said star-shaped elevations 11. Said through borings 13 are provided to receive pins 14 formed on the inside of orifice 10 of the protruding end 4' of handle half 2'.

The shape of connecting plates 9 and of orifices 10 receiving the same may be varied as desired, of course. Similarly, different shapes may be chosen for elevations 11 and orifices 12, of course.

Prior to assembling the two handle halves 2', 2" via insert pins 7 and corresponding insert sleeves 7' on the insides of handle halves 2', 2", the connecting plates 9 of connecting elements 4 of bite-on part 3 are placed into the orifices 10 of protruding ends 4' of lower handle half 2', so that the pins 14 on the insides of the protruding ends of handle half 2' pass through the through borings 13 of the connecting plates 9 of connecting elements 4. When the upper handle half 2" is put together with the lower handle half 2', the upper handle half 2" is easily attached via insert sleeves 7' and insert pins 7 on the insides of handle halves 2', 2" (see FIG. 2*b*). The elevations 11 extend through the orifices 12 in handle halves 2', 2" and are thus visible from outside. Subsequently, the edges of the two handle halves 2', 2" are welded by means of ultrasonic welding to make the positive connection non-detachable.

A snap-on connection may be provided instead of said non-detachable positive connection of the individual components, which connection may e.g. be provided by a circumferential flange extending around the inner edge of the insert sleeves and a corresponding flange extending around the outer edge of insert pins 7.

FIG. 4 shows an alternative embodiment of device 1 according to the present invention. Said device 1 itself is shaped as in the embodiment according to FIGS. 1 to 3, but, contrary to said positive connection, the handle 2 and the bite-on part 3 are formed integrally by means of a two component injection molding process. Each freely protruding end 4' of handle 2 is provided with a channel 17 widening radially outwards from the orifice 12 in handle 2. The opening of said channel 17 on the side of the edge essentially corresponds to the width (in top view) of connecting bridge 8 of connecting element 4.

Thus, the material for forming the bite-on part 3, which is softer than the material of the handle 2, may easily enter orifice 10 and orifices 12 during a two component injection molding process, resulting in a non-detachable, integral form of device 1. Using a three component injection molding process, e.g. the stars shown on handle 2 may be made of softer material than the remaining handle 2.

FIG. 5 also shows that the plate-shaped basic body 3' of bite-on part 3 may increase in height from the center of its curvature, which is located in the middle, towards the two freely protruding end areas, so that it will be thicker on the edges than in the center. Thus, both an infant's incisors, which usually erupt first, and the molars, which are usually not as high yet, may rest on the plate-shaped basic body 3' and may contact the massage and cleaning projections. Thus, the entire curvature of the gums of a teething infant will be cleaned and massaged. Of course, such kind of thickening plate-shaped basic body may advantageously also be used independently of said non-detachable connection between handle 2 and bite-on part 3. The same effect of cleaning and massaging the entire curvature of the jaw and gums of a teething infant is also achieved by the embodiment shown in FIG. 5*a*. In this case, the basic body 3' is of essentially constant thickness, whereas the height of the bristle-like projections 5 increases symmetrically from the center of the curvature of bite-on part 3 towards the ends of said bite-on part 3, thus providing contact with the molars that have not yet grown to the same level as the incisors.

What is claimed is:

1. A device for massaging the gums and cleaning the teeth of an infant, said device comprising a handle and a plate-shaped bite-on part curved essentially corresponding to the curvature of an infant's jaw, said bite-on part having massage and cleaning projections on at least either the upper or the lower surface, said handle having two freely protruding ends for connection to said bite-on part, and said bite-on part having a softer material than said handle, wherein connecting elements are formed on said bite-on part for connection to said handle, with each element being positively received in an orifice of said handle, or said handle and said bite-on part are integrally formed by means of a two or three component injection molding process so that said handle and said bite-on part are connected in a non-detachable manner.

2. A device according to claim 1, wherein said bite-on part comprises a circumferential wall extending upwards and downwards from a plate-shaped basic body, the inside of the wall being at least partially provided with the massage and cleaning projections, particularly bristle-like projections.

3. A device according to claim 1, wherein said bite-on part is shaped in such a way that it essentially corresponds to the entire curvature of the infant's jaw.

4. A device according to claim 3, wherein the thickness of a wall of a plate-shaped basic body of said bite-on part increases from the center of the curvature towards the ends.

5. A device according to claim 3, wherein the bite-on part comprises a circumferential wall extending upwards and downwards from a plate-shaped basic body, wherein the thickness of a wall of said plate-shaped basic body is essentially constant, whereas the height of said massage and cleaning projections increases from the center of the curvature of said bite-on part towards its ends.

6. A device according to claim 5, having connecting elements to be positively received by the handle, wherein said connecting elements are formed on the outer edges of the end sections of said bite-on part and extend essentially radially from the center of the curvature of a U-shaped bite-on part.

7. A device according to claim 1, wherein said bite-on part is positively connected to said handle by the connecting elements.

8. A device according to claim 7, wherein the orifice in said handle receiving at least one elevation of said connecting elements.

9. A device according to claim 7, further comprising through borings in said connecting elements through which pins of said handle are passed.

10. A device according to claim 1, having connecting elements to be positively received by the handle, wherein said handle is divided into two halves by a central plane extending horizontally when said handle is viewed from above.

11. A device according to claim 10, wherein insert sleeves and corresponding insert pins are provided on the insides of said handle halves for connecting said two halves.

12. A device according to claim 10, wherein said handle halves are welded to form a non-detachable connection.

13. A method for producing a device according to claim 12, wherein prior to connecting said two handle halves, said connecting elements of said bite-on part are positively connected to the corresponding ends of said handle halves, and then said handle halves are welded, adhered or snapped together.

14. A device according to claim 1, wherein said handle is essentially U-shaped.

15. A device according to claim 1, wherein said bite-on part is arranged concavely with respect to said handle.

16. A device according to claim 1, wherein said handle is made of at least one of polypropylene and polycarbonate.

17. A device according to claim 1, wherein said handle has a Shore hardness D of about 20 to about 50.

18. A device according to claim 1, wherein said bite-on part is made of at least one of silicone and thermoplastic elastomers.

19. A device according to claim 1, wherein said bite-on part has a Shore hardness A of about 30 to about 70.

20. A method for producing a device according to claim 1, wherein said device is produced in one piece by means of a two component injection molding process.

* * * * *